United States Patent [19]

Snyder

[11] Patent Number: 4,957,459

[45] Date of Patent: Sep. 18, 1990

[54] PROPELLER SHROUD WITH LOAD BEARING STRUCTURE

[75] Inventor: Richard H. Snyder, Oshkosh, Wis.

[73] Assignee: Brunswick Corporation, Skokie, Ill.

[21] Appl. No.: 397,727

[22] Filed: Aug. 23, 1989

[51] Int. Cl.[5] ..... B63H 5/16

[52] U.S. Cl. ..... 440/72; 416/247 A; 440/71

[58] Field of Search ..... 440/66, 71, 72; 416/247 A, 247 R

[56] References Cited

U.S. PATENT DOCUMENTS

| | | | |
|---|---|---|---|
| 2,244,217 | 6/1941 | Pries . | |
| 2,706,960 | 4/1955 | Crew | 440/72 |
| 2,723,641 | 11/1955 | Taylor | 416/247 A |
| 3,035,538 | 5/1962 | Willard . | |
| 3,859,953 | 1/1975 | Todt . | |
| 4,078,516 | 3/1978 | Balius | 440/72 |
| 4,565,533 | 1/1986 | Springer | 440/71 |
| 4,637,801 | 1/1987 | Schultz . | |
| 4,680,017 | 7/1987 | Eller | 440/72 |
| 4,826,461 | 5/1989 | Newman | 440/71 |

FOREIGN PATENT DOCUMENTS

| | | | |
|---|---|---|---|
| 564057 | 9/1958 | Canada | 440/72 |

*Primary Examiner*—Sherman Basinger
*Assistant Examiner*—Thomas J. Brahan
*Attorney, Agent, or Firm*—Andrus, Sceales, Starke & Sawall

[57] ABSTRACT

In a marine drive (10), a propeller shroud is provided by a cage (24) having internal spoke structure (26, 28, 38, 40, 46, 48) and having retainer structure (50, 74) mounting the cage (24) to the gearcase (12) and engaging the gearcase (12) and driveshaft housing (11) in a particular manner such that impact force on the cage (24) is transmitted to 1) the junction of the lower skeg (20) and the torpedo-shaped portion (14) of the gearcase (12), 2) the leading edge of the gearcase (12) at the front edge (31) of the strut portion (23) and the front edge (33) of the skeg (20), 3) the underside of the anti-ventilation plate (22), and 4) the rearwardly extending portion (52) of the driveshaft housing (11) above the anti-ventilation plate (22) and the splash plate (13).

18 Claims, 4 Drawing Sheets

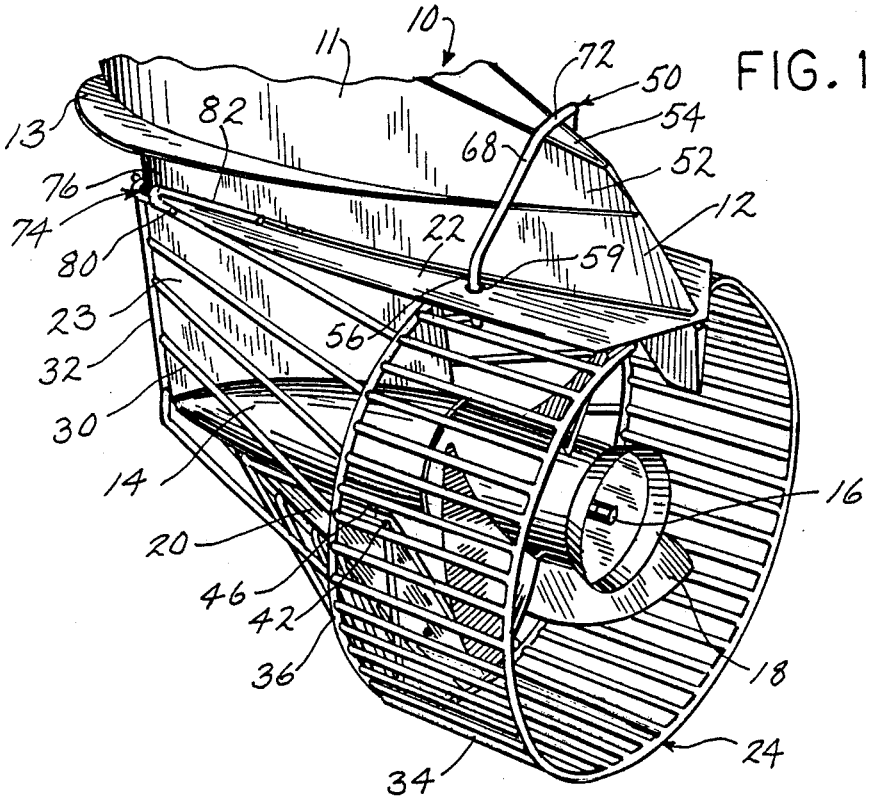
FIG. 1
FIG. 2
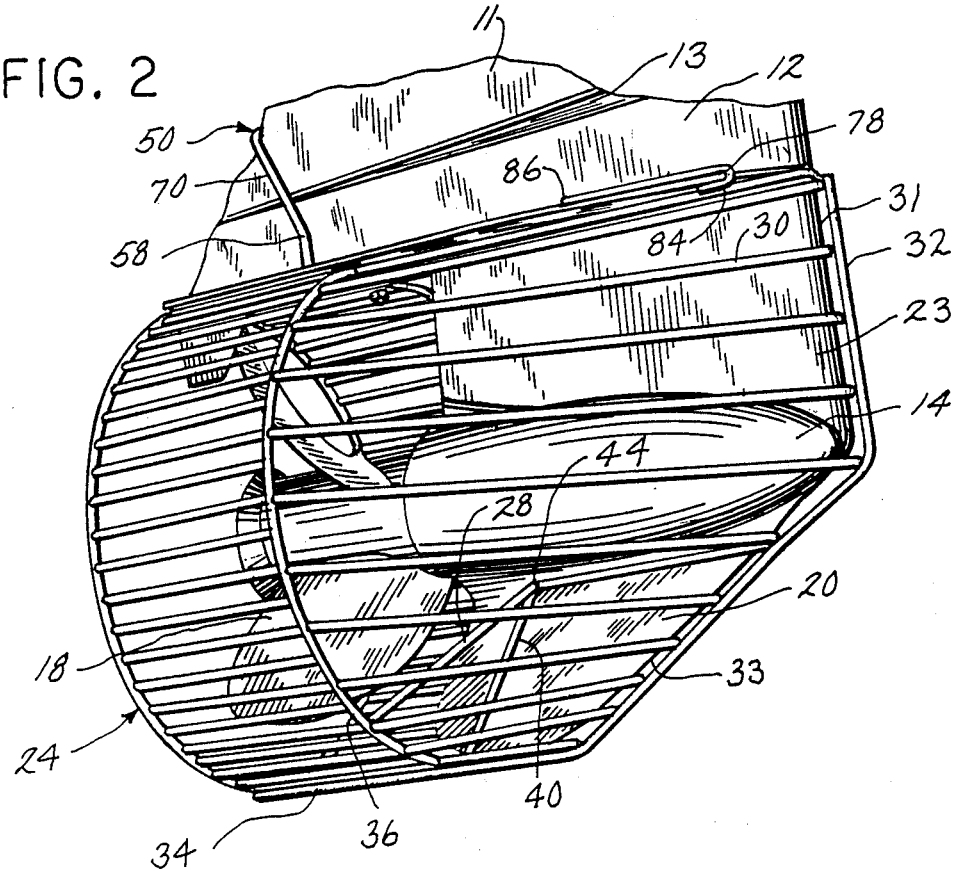

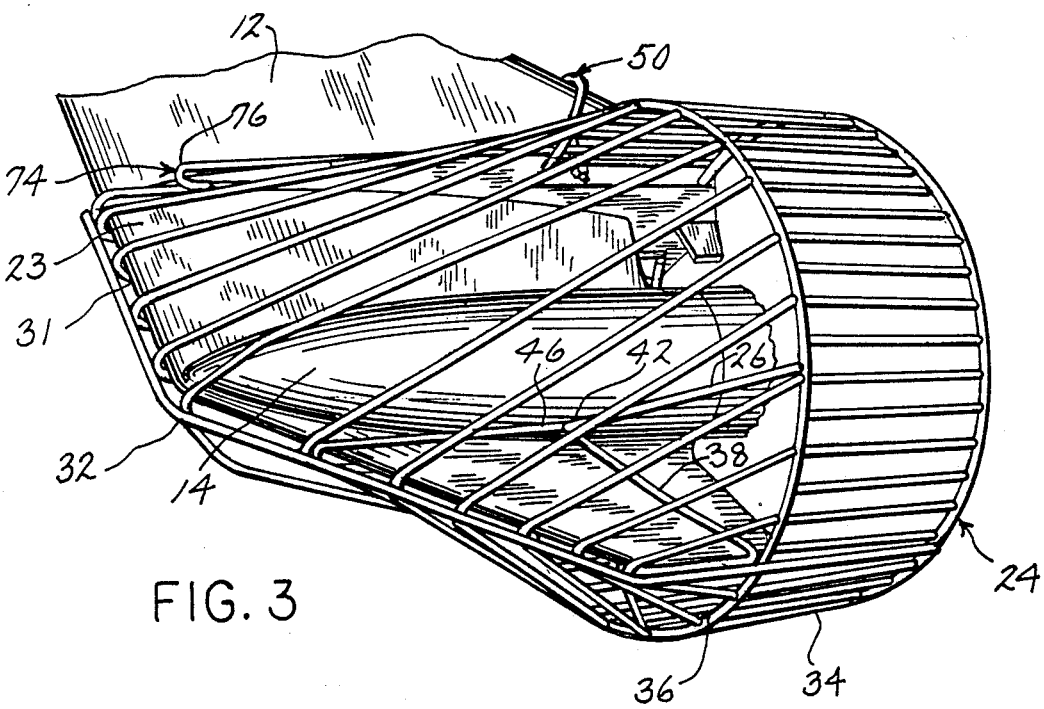
FIG. 3
FIG. 4
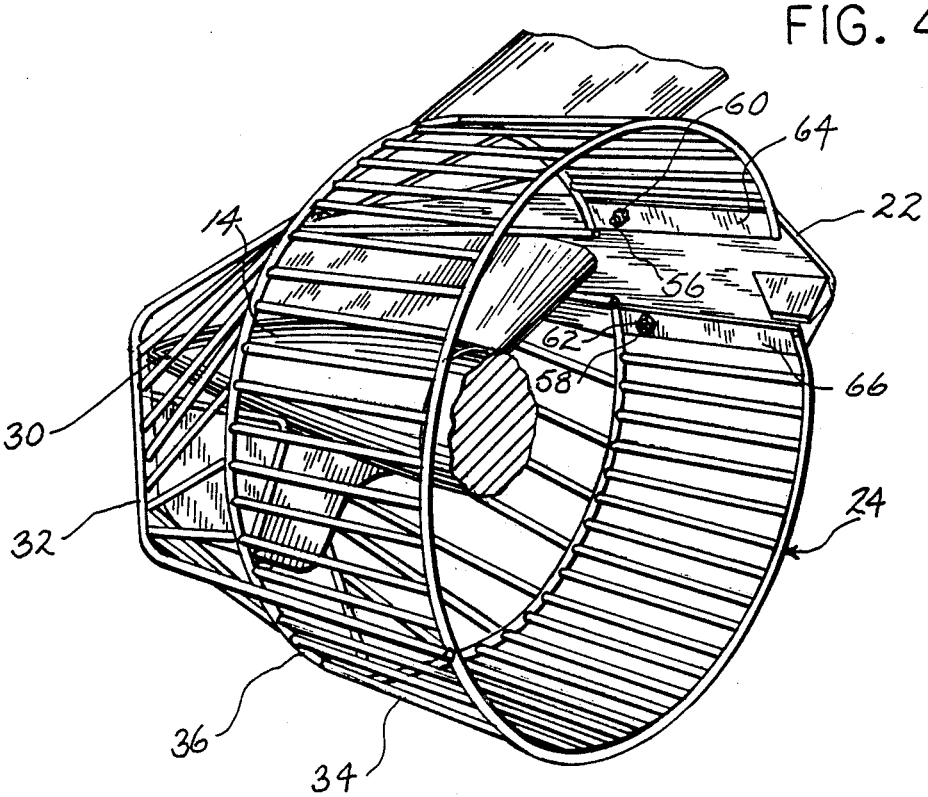

PROPELLER SHROUD WITH LOAD BEARING STRUCTURE

BACKGROUND AND SUMMARY

The invention relates to propeller shrouds for marine drives. Propeller shrouds are known in the art, for example as shown in U.S. Pat. No. 2,244,217, 3,035,538, 3,859,953, 4,637,801, 4,680,017, 4,826,461.

The present invention provides a propeller shroud having special load bearing structure so that when it is attached to the gearcase of an outboard motor or stern drive, the force from heavy loads or shock blows on the shroud will be transmitted to the strongest elements of the gearcase. Impact force on the shroud is transmitted to (1) the junction of the skeg and the torpedo-shaped portion of the gearcase, (2) the leading edge of the strut portion of the gearcase, (3) the underside of the anti-ventilation plate, and (4) the rearwardly extending portion of the driveshaft housing above the anti-ventilation plate and the splash plate. This increases life, and minimizes breakage problems.

BRIEF DESCRIPTION OF THE DRAWINGS

FIG. 1 is a perspective view of a propeller shroud constructed in accordance with the invention.

FIG. 2 shows the shroud of FIG. 1 from a different view.

FIG. 3 shows the shroud of FIG. 1 from another different view.

FIG. 4 shows the shroud of FIG. 1 from another different view.

DETAILED DESCRIPTION

Figure 5:
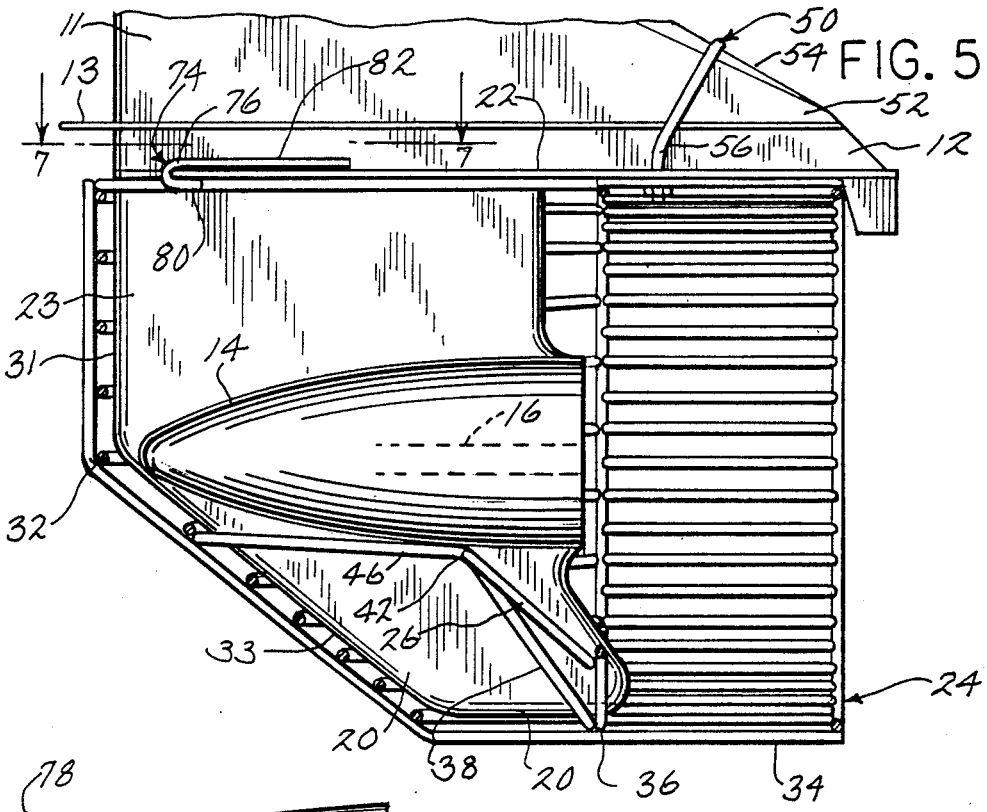
FIG. 5 is a side view of the shroud of FIG. 1, partially broken away.
Figure 7:
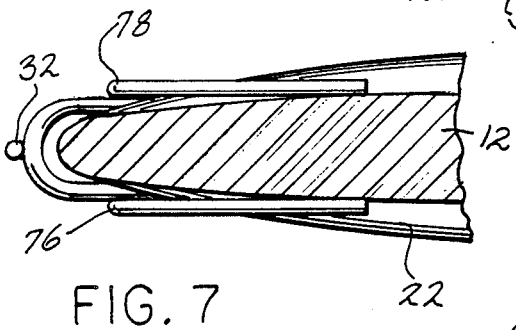
FIG. 7 is a sectional view taken along line 7—7 of FIG. 5.

FIG. 1 shows a marine drive 10 having a driveshaft housing 11 separated from a gearcase 12 therebelow by a splash plate 13. The gearcase has a lower submerged torpedo-shaped portion 14 having a propeller shaft 16 carrying a propeller 18 at the back end thereof. A skeg 20 extends downwardly from torpedo-shaped portion 14. Anti-ventilation plate 22 is above propeller 18 and extends forwardly along the gearcase. Strut portion 23 of the gearcase is between torpedo-shaped portion 14 and anti-ventilation plate 22.

A propeller shroud is provided by a welded wire cage 24 around the gearcase and propeller. Cage 24 has a pair of inner spokes 26 and 28, FIG. 6, extending inwardly and bearing against the junction of skeg 20 and torpedo-shaped portion 14 of gearcase 12 such that impact force on the cage is transmitted to such junction. Cage 24 has a front portion 30 with a leading edge 32 extending along the front of the gearcase at front leading edge 31 of strut portion 23 and front leading edge 33 of skeg 20. The wires of front portion 30 on one side of the gearcase extend around the front of the gearcase and are continuous and integral with the wires of the front portion of the cage on the other side of the gearcase. Front portion 30 of the cage tapers rearwardly and outwardly. The cage has a rear generally cylindrical portion 34 around propeller 18 and extending rearwardly from front portion 30. The cage has a generally circular rib 36 at the intersection of front and rear portions 30 and 34. Spokes 26 and 28 extend generally radially inwardly from circular rib 36 to the junction of skeg 20 and torpedo-shaped portion 14 of the gearcase. Each of spokes 26 and 28 forms an acute angle with skeg 20.

Figure 6:
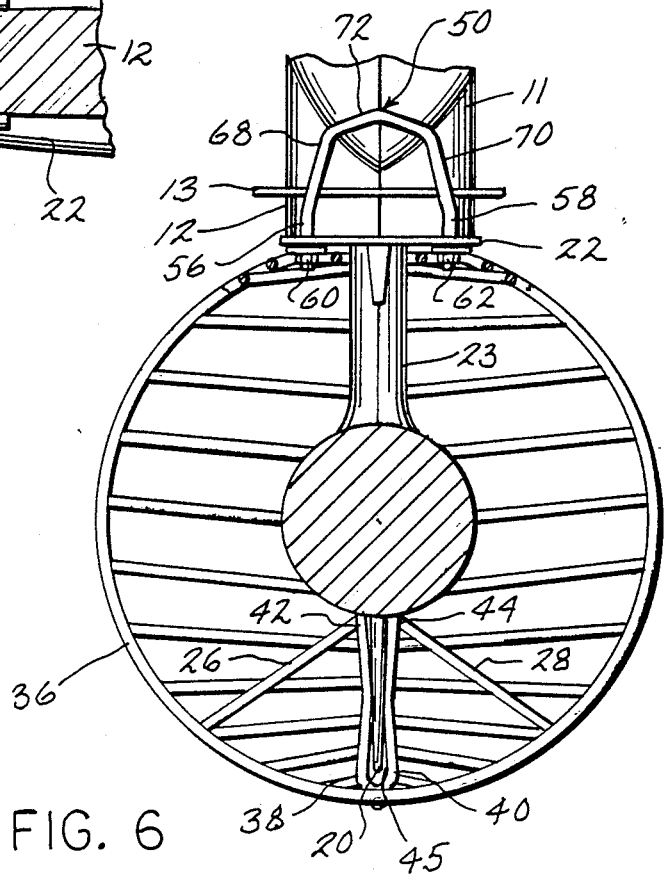
FIG. 6 is an end view of the shroud in FIG. 5.

In addition to the first pair of spokes 26 and 28, a second pair of spokes 38 and 40 is provided, FIG. 6. Spokes 26 and 38 extend from circular rib 36 forwardly and inwardly to a common point 42 at the junction of skeg 20 and torpedo-shaped portion 14 of the gearcase on one side of skeg 20. Spokes 26 and 38 form an acute angle therebetween. Spokes 28 and 40 extend from circular rib 36 forwardly and inwardly to a common point 44 at the junction of skeg 20 and torpedo-shaped portion 14 of the gearcase on the other side of skeg 20. Spokes 28 and 40 form an acute angle therebetween. Spokes 38 and 40 extend generally vertically and parallel to each other with a small gap therebetween receiving skeg 20. Spokes 38 and 40 are bent slightly toward one another so that the resulting gap 45 will be lightly spring loaded against skeg 20 when fully installed.

A third pair of spokes is provided by spokes 46 and 48, FIGS. 1–4. Spoke 46 extends from common point 42 forwardly along the junction of skeg 20 and torpedo-shaped portion 14 of the gearcase on the noted one side of the skeg, FIG. 3, to leading edge 32 of front portion 30 of the cage. Spoke 48 extends from common point 44 forwardly along the junction of skeg 20 and torpedo-shaped portion 14 of the gearcase on the noted other side of the skeg, FIG. 2, to leading edge 32 of front portion 30 of the cage.

Cage 24 is mounted to the gearcase by a retainer 50 around rearwardly extending portion 52 of driveshaft housing 11 above anti-ventilation plate 22 and splash plate 13. Rearwardly extending portion 52 of the driveshaft housing has an upper surface 54 which is tapered downwardly and rearwardly. Retainer 50 extends around and straddles rearwardly extending portion 52 at right angles to tapered upper surface 54. Cage 24 is below anti-ventilation plate 22. Retainer 50 extends downwardly through anti-ventilation plate 22.

Retainer 50 is an inverted generally U-shaped bolt having lower legs 56 and 58 extending generally vertically downwardly through respective clearance holes such as 59 in anti-ventilation plate 22 to engage cage 24 therebelow at bolt ends 60 and 62 bearing against the underside of plates 64 and 66 welded between adjacent wires of the cage, FIG. 4. Retainer 50 has upper legs 68 and 70 bent at an obtuse angle relative to respective lower legs 56 and 58 and extending upwardly and rearwardly to an upper bight 72 extending transversely across tapered upper surface 54 of rearwardly extending portion 52 of the driveshaft housing. Upper legs 68 and 70 extend generally at right angles relative to downwardly and rearwardly tapered upper surface 54.

Cage 24 includes a second retainer 74 around the front portion of anti-ventilation plate 22 and mounting the cage thereto. Retainer 74 is provided by a pair of generally J-shaped fingers 76 and 78 on opposite sides of the gearcase J-shaped finger 76 has a lower finger portion 80 welded to the cage and extending generally horizontally rearwardly along the underside of anti-ventilation plate 22. J-shaped finger 76 has an upper finger portion 82 extending generally horizontally rearwardly along the top of anti-ventilation plate 22. J-shaped finger 78 has a lower finger portion 84 welded to the cage and extending generally horizontally rearwardly along the underside of anti-ventilation plate 22. J-shaped finger 78 has an upper finger portion 86 extending generally horizontally rearwardly along the top of anti-ventilation plate 22.

During installation, the cage is slid rearwardly, with the gap between plates 64 and 66 receiving strut portion 23 of the gearcase, until the front edge 32 of the cage engages front edge 31 of strut portion 23 and front edge 33 of skeg 20 of the gearcase, with J-shaped fingers 76 and 78 engaging the front of anti-ventilation plate 22, and with skeg 20 received in the gap 45 between spokes 38 and 40. Clamp 50 is then installed, and nuts 60 and 62 are tightened on lower bolt legs 56 and 58.

In one embodiment, the welded wires of the cage are spaced by ⅝ of an inch and have a diameter of 5/16 of an inch. This spacing and wire size may be increased or decreased depending on specific requirements of object exclusion, strength desired, size of engine, etc.

Impact force on cage 24 is transmitted to (1) the junction of skeg 20 and torpedo-shaped portion 14 of the gearcase, (2) the leading edge of the gearcase at front edge 31 of strut portion 23 and front edge 33 of skeg 20, (3) the underside of anti-ventilation plate 22, and (4) rearwardly extending portion 52 of the driveshaft housing above anti-ventilation plate 22 and splash plate 13.

Figure 8:
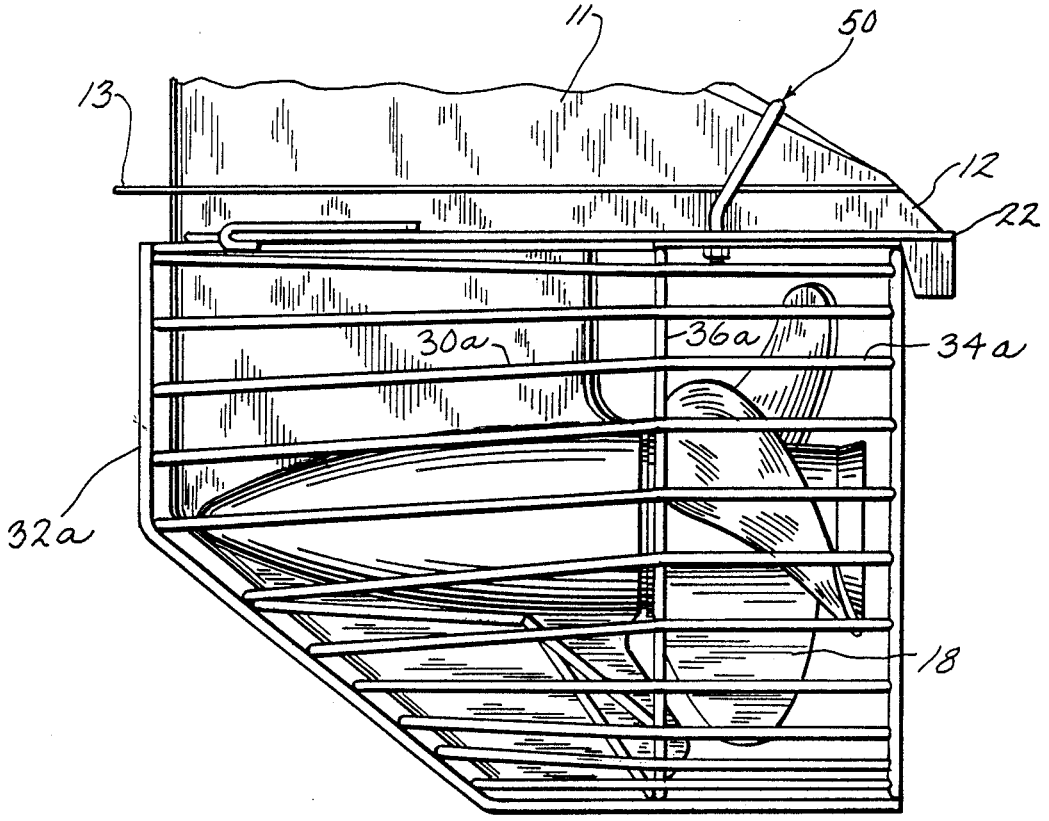
FIG. 8 shows another embodiment.

A further embodiment is shown in FIG. 8, where like reference numerals are used from FIGS. 1–7 where appropriate to facilitate understanding. The wire portions **30*a* at the front portion of the cage are continuous and integral with the wire portions 34*a* at the rear portion of the cage and are welded to rib 36*a* with a T-type weld, rather than a butt-type weld of separate wires to rib 36 as in FIGS. 1–7. The continuous wire, with portions 34*a* and 30*a*, extends around the front of the gearcase and is continuous and integral with the wire extending along the other side of the gearcase. The embodiment of FIG. 8 provides a stronger cage, not subject to cracking of butt-type welds of separate wires at rib 36. In a further embodiment, not shown, another rib or lateral crossbar is added midway along wire portions 30*a* between hoop 36*a* and front edge 32*a* and is welded to such midpoint of wire portions 30*a*** to reduce vibration.

It is recognized that various equivalents, alternatives and modifications are possible within the scope of the appended claims.

I claim:

1. In a marine drive having a driveshaft housing and a gearcase having a lower submerged torpedo-shaped portion having a propeller shaft carrying a propeller at the back end thereof, and having a skeg extending downwardly from said torpedo-shaped portion, a propeller shroud comprising a cage around said gearcase and said propeller and mounted to said gearcase and having a pair of inner spokes extending inwardly and bearing against the junction of said skeg and said torpedo-shaped portion such that impact force on said cage is transmitted to said junction, wherein said gearcase has a leading strut portion above said torpedo-shaped portion, and wherein:

said cage has a front portion with a leading edge extending along the front of said strut-portion and said skeg, said front portion of said cage tapering rearwardly and outwardly;

said cage has a rear generally cylindrical portion around said propeller and extending rearwardly from said front portion;

said cage has a generally circular rib at the intersection of said front and rear portions;

said spokes extend generally radially inwardly from said circular rib to said junction of said skeg and said torpedo-shaped portion.

2. The invention according to claim 1 wherein each of said spokes forms and acute angle with said skeg.

3. The invention according to claim 2 comprising a second pair of spokes, the first spoke of the first pair and the first spoke of the second pair being on one side of said skeg, the second spoke of the first pair and the second spoke of the second pair being on the other side of said skeg, said first spokes forming an acute angle therebetween, said second spokes forming an acute angle therebetween.

4. The invention according to claim 3 wherein said spokes of said second pair extend generally vertically and parallel to each other with a small gap therebetween receiving said skeg.

5. The invention according to claim 4 wherein said spokes of said second pair are lightly spring loaded against said skeg.

6. The invention according to claim 5 wherein said spokes of said second pair are bent slightly toward one another to provide said light spring loading at said gap against said skeg.

7. The invention according to claim 4 wherein said first spoke of said first pair and said first spoke of said second pair meet at a first common point at the junction of said skeg and said torpedo-shaped portion on said one side of said skeg, said second spoke of said first pair and said second spoke of said second pair meet at a second common point at the junction of said skeg and said torpedo-shaped portion on said other side of said skeg.

8. The invention according to claim 7 comprising a third pair of spokes, the first spoke of said third pair extending from said first common point forwardly along said junction of said skeg and said torpedo-shaped portion on said one side of said skeg to said leading edge of said front portion of said cage, the second spoke of said third pair extending from said second common point forwardly along the junction of said skeg and said torpedo-shaped portion on said other side of said skeg to said leading edge of said front portion of said cage.

9. The invention according to claim 8 wherein said first spokes of said first and second pairs extend from said circular rib forwardly and inwardly to said first common point, said second spokes of said first and second pairs extend from said circular rib forwardly and inwardly to said second common point.

10. In a marine drive having a driveshaft housing and a gearcase having a lower submerged torpedo-shaped portion having a propeller shaft carrying a propeller at the back end thereof, and having an anti-ventilation plate above said propeller, said driveshaft housing having a portion extending rearwardly and above said anti-ventilation plate, a propeller shroud comprising a cage around said gearcase and said propeller and mounted to said driveshaft housing by a retainer around said rearwardly extending portion of said driveshaft housing above said anti-ventilation plate, wherein said rearwardly extending portion of said driveshaft housing has an upper surface which is tapered downwardly and rearwardly, and wherein said retainer extends around and straddles said rearwardly, and wherein said retainer extends around and straddles said rearwardly extending portion of said driveshaft housing at right angles to said tapered upper surface.

11. The invention according to claim 10 wherein said cage is below said anti-ventilation plate, and wherein said retainer extends downwardly through clearance holes in said anti-ventilation plate.

12. The invention according to claim 11 wherein said retainer is an inverted generally U-shaped bolt having lower legs extending generally vertically downwardly through said anti-ventilation plate to engage said cage therebelow, and having upper legs bent at an obtuse angle relative to said lower legs and extending upwardly and rearwardly to an upper bight extending transversely across said tapered upper surface of said rearwardly extending portion of said driveshaft housing, said upper legs extending generally at right angles relative to said downwardly and rearwardly tapered upper surface of said rearwardly extending portion of said driveshaft housing.

13. The invention according to claim 10 wherein said anti-ventilation plate extend forwardly along said gearcase, and comprising in combination a second retainer around a front portion of said anti-ventilation plate and mounting said case thereto.

14. The invention according to claim 13 wherein said second retainer comprises a pair of generally J-shaped fingers on opposite sides of said gearcase, each J-shaped finger having a lower finger portion attached to said cage and extending generally horizontally rearwardly along the underside of said anti-ventilation plate, and having an upper finger portion extending generally horizontally rearwardly along the top of said anti-ventilation plate.

15. The invention according to claim 14 wherein said cage comprises a welded wire structure, and said J-shaped fingers each comprise a wire welded to said structure.

16. In a marine drive having a driveshaft housing and gearcase having a lower submerged torpedo-shaped portion having a propeller shaft carrying a propeller at the back end thereof, and having a skeg extending downwardly from said torpedo-shaped portion, and having an anti-ventilation plate above said propeller, said driveshaft housing having a rearwardly extending portion above said anti-ventilation plate, said gearcase having a strut portion between said torpedo-shaped portion and said anti-ventilation plate, a propeller shroud comprising a cage around said gearcase and said propeller and having a front portion with a leading edge extending along the leading edge of said strut portion and along the leading edge of said skeg, said cage having a pair of inner spokes extending inwardly and bearing against the junction of said skeg and said torpedo-shaped portion, said cage being mounted to said gearcase by a retainer extending around said rearwardly extending portion of said driveshaft housing such that impact force on said cage is transmitted to (1) the junction of said skeg and said torpedo-shaped portion, (2) the leading edge of said strut portion and said skeg, (3) the underside of said anti-ventilation plate, and (4) said rearwardly extending portion of said driveshaft housing above said anti-ventilation plate, wherein said front portion of said cage tapers rearwardly and outwardly, said cage has a rear generally cylindrical portion around said propeller and extending rearwardly from said front portion, said cage has a generally circular rib at the intersection of said front and rear portions, said spokes extend generally radially inwardly from said circular rib to said junction of said skeg and said torpedo-shaped portion, said rearwardly extending portion of said driveshaft housing has an upper surface which is tapered downwardly and rearwardly, said retainer extends around and straddles said rearwardly extending portion of said driveshaft housing at right angles to said tapered upper surface.

17. The invention according to claim 16 comprising a second pair of spokes, the first spoke of the first pair and the first spoke of the second pair being on one side of said skeg, the second spoke of the first pair and the second spoke of the second pair being on the other side of said skeg, said first spokes forming an acute angle therebetween, said second spokes forming an acute angle therebetween, the first spoke of the first pair forming an acute angle with said skeg, the second spoke of the first pair forming an acute angle with said skeg, and wherein said spokes of said second pair extend generally vertically and parallel to each other with a small gap therebetween receiving said skeg, said spokes of said second pair being lightly spring loaded against and engaging said skeg in said gap, said first spoke of said first pair and said first spoke of said second pair meet at a first common point at the junction of skeg and said torpedo-shaped portion on said one side of said skeg, said second spoke of said first pair and said second spoke of said second pair meet at a second common point at the junction of said skeg and said torpedo-shaped portion on said other side of said skeg, and comprising a third pair of spokes, the first spoke of said third pair extending from said first common point forwardly along the junction of said skeg and said torpedo-shaped portion on said one side of said skeg to said leading edge of said front portion of said cage, the second spoke of said third pair extending from said second common point forwardly along the junction of said skeg and said torpedo-shaped portion on said other side of said skeg to said leading edge of said front portion of said cage, said first spokes of said first and second pairs extend from said circular rib forwardly and inwardly to said first common point, said second spokes of said first and second pairs extend from said circular rib forwardly and inwardly to said second common point, said retainer is an inverted generally U-shaped bolt having lower legs extending generally vertically downwardly through clearance holes in said anti-ventilation plate to engage said cage therebelow, and having upper legs bent at an obtuse angle relative to said lower legs and extending upwardly and rearwardly to an upper bight extending transversely across said tapered upper surface of said rearwardly extending portion of said driveshaft housing, said upper legs extending generally at right angles relative to said downwardly and rearwardly tapered upper surface of said rearwardly extending portion of said driveshaft housing.

18. The invention according to claim 17 wherein said anti-ventilation plate extends forwardly along said gearcase, and comprising a second retainer comprising a pair of generally J-shaped fingers on opposite sides of said gearcase, each J-shaped finger having a lower finger portion attached to said cage and extending generally horizontally rearwardly along the underside of said anti-ventilation plate, and having an upper finger portion extending generally horizontally rearwardly along the top of said anti-ventilation plate.

* * * * *